United States Patent [19]

Endicott

[11] Patent Number: 4,829,686

[45] Date of Patent: May 16, 1989

[54] MESSAGE CENTER

[76] Inventor: William L. Endicott, 1209 Hilltop Ave., Wilmington, Del. 19809

[21] Appl. No.: 81,739

[22] Filed: Aug. 5, 1987

[51] Int. Cl.[4] ..... G09F 7/00

[52] U.S. Cl. ..... 40/492; 40/124.2; 40/312

[58] Field of Search ..... 40/124, 124.2, 312, 40/492, 10, 310

[56] References Cited

U.S. PATENT DOCUMENTS

| | | | |
|---|---|---|---|
| 567,379 | 9/1896 | Dalumi . | |
| 707,236 | 8/1902 | Kelly | 40/492 |
| 878,554 | 2/1908 | Muschesheim | 40/492 |
| 2,110,128 | 6/1935 | Kent . | |
| 2,302,771 | 11/1942 | Hobby | 40/492 |
| 2,659,486 | 11/1953 | Krupin | 40/492 |
| 2,738,605 | 3/1956 | Johnson | 40/124.2 |
| 4,163,332 | 8/1979 | Salam . | |
| 4,389,804 | 6/1983 | Selbert . | |

*Primary Examiner*—Gene Mancene
*Assistant Examiner*—Wenceslao J. Contreras
*Attorney, Agent, or Firm*—Connolly & Hutz

[57] ABSTRACT

A message center comprises a housing having a plurality of compartments each of which would correspond to a particular individual. The front wall of the housing includes a plurality of openings one for each compartment to provide access to the compartment. Each compartment is provided with a pivotally mounted plate which may be selectively moved to and from a generally horizontal position and a generally vertical position. When the plate is in the generally horizontal position it functions as the floor of its compartment. When the plate is in its generally vertical position it closes the opening and functions as a door to its compartment.

25 Claims, 2 Drawing Sheets

MESSAGE CENTER

BACKGROUND OF INVENTION

This invention is concerned with providing a message center which may indicate the presence or absence of various personnel as well as holding messages for the individuals. Generally, businesses having a number of employees must provide some means at a central location to take messages or otherwise make known which employees are present and which are absent. For example, a switchboard operator might include a list of all such employees near the switchboard. Each day some notation would be made to indicate when an employee is present. This would get cumbersome for employees who are both present and absent for different periods of the same day. It is also customary for the switchboard operator to take messages such as telephone messages or hold personal items for temporarily absent employees.

SUMMARY OF INVENTION

An object of this invention is to provide a message center which could be used in a convenient manner to indicate the presence or absence of employees and also to hold messages for absent employees.

A further object of this invention is to provide such a message center which may be conventionally operated by the users. In accordance with this invention a message center comprises a housing having a plurality of compartments with each compartment being provided for a particular individual. The front wall of the housing has a plurality of openings corresponding to the number of compartments to provide access to the compartments. A plate is mounted in each compartment and movable to and from a generally horizontal position and a vertical position. When the plate is in its generally horizontal position the plate functions as a floor of the compartment and may support messages or other personal items for absent employees. The employee upon coming to work would remove the messages and items from the compartment and then move the plate to its vertical position where the plate acts as a door closing the opening of its compartment and thereby visually indicating the presence of the employee. A switchboard operator could then readily see which employees are present and which are absent.

In a preferred form of this inventor a photograph of each employee would be mounted on the respective plates to assist the switchboard operator in identifying the present employees.

Preferably the plate is mounted on a rotatable shaft within the compartment with the shaft secured to a manually operable control knob which is accessible from the exterior of the housing.

THE DRAWINGS

DETAILED DESCRIPTION

Figure 1:
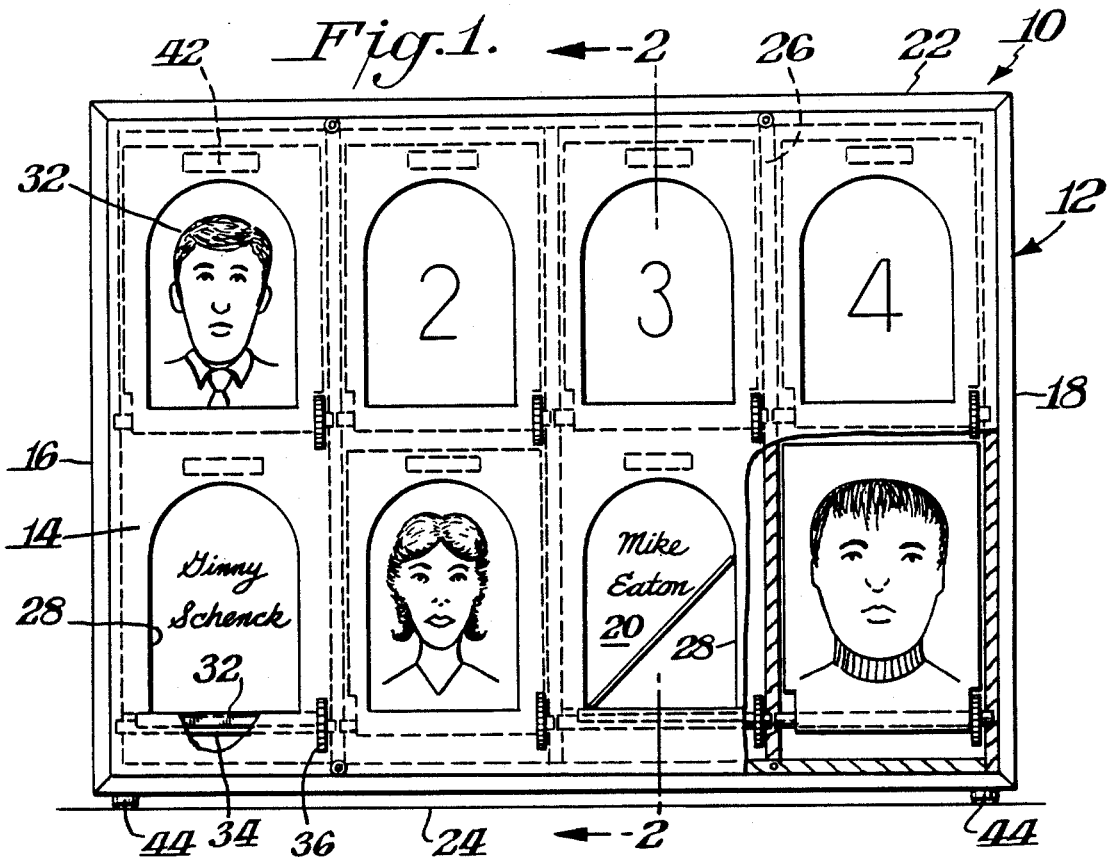
FIG. 1 is a front elevational view of a message center in accordance with this invention.
Figure 2:
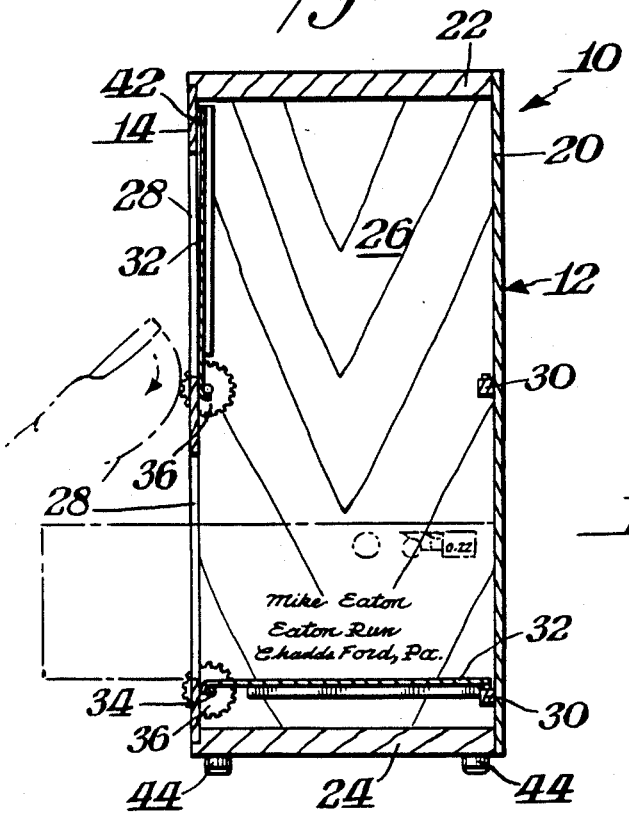
FIG. 2 is a cross-sectional view taken through FIG. 1 along the line 2—2.
Figure 3:
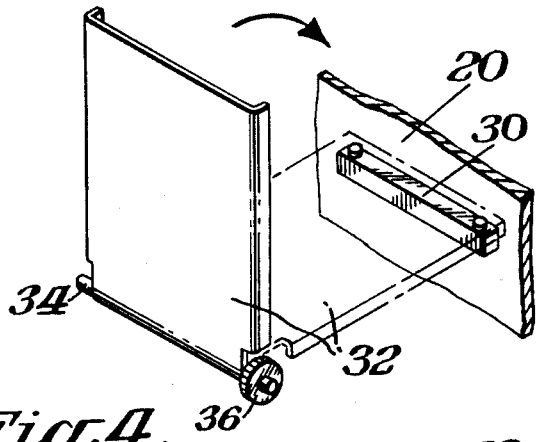
FIG. 3 is an exploded view of one of the compartments in the message center shown in FIGS. 1–2.

FIGS. 1–4 illustrate a message center 10 in accordance with this invention. As shown therein message center 10 is in the form of a housing 12 which comprises a vertical front wall 14 a pair of side walls 16, 18, a rear wall 20, a top wall 22 and a bottom wall 24. A plurality of vertical inner walls 26 are informally mounted at spaced locations to divide housing 12 into sections. In the embodiment illustrated in FIGS. 1–2 front wall 14 has a plurality of openings 28 providing access to the interior of housing 12. Each opening would be provided for a compartment in the housing 12. As shown in FIG. 3 a plurality of support bars 30 is mounted on the rear wall 20 with each support bar being spaced opposite a respective opening 28.

In accordance with this invention each compartment is provided with a rotatable plate 32 mounted on a shaft 34 which may be moved to and from a generally horizontal position and a generally vertical position by finger manipulation of knurled knob 36 secured to the end of shaft 34. Advantageously when plate 32 is in its generally horizontal position, as in the lower compartment of FIG. 2, plate 32 comprises the floor of that compartment. When housing plate 32 is in its vertical position as in the upper compartment of FIG. 2 plate 32 closes is opening and functions as a door for that compartment.

For use as a message center each compartment would be assigned to a different individual. Some form of indicia would be used to identify the individuals. In the preferred form of this invention the indicia is a photograph of the individual.

In operation at the beginning of the work day all of the plates 32 would be in the generally horizontal position, thus indicating that none of the individuals is yet at work. As each individual arrives at work the individual would rotate plate 32 for that individual's compartment by manipulating knob 36 a illustrated in FIG. 2. If in the meantime there had been messages for that individual or other items such as keys have been left for the individual those items would have been placed upon plate 32 and the individual would remove the items before moving plate 32 to the vertical position. FIG. 2 for example illustrates a letter to be in one of the compartments supported by plate 32. The letter would project outwardly from the compartment thereby alerting the individual that there is a message in the compartment. If for some reason the individual did not realize that any message or personal item had been left in the compartment then when plate 32 is rotated to the vertical position the message or item would be carried with the plate toward opening 28 and the individual would become aware of those items. During the course of a work day various plates 32 would be moved to the vertical position closing the opening 28 of each compartment. The switchboard operator could readily tell at a glance who is in and who is not in and thus could conveniently handle any telephone or other messages.

FIG. 3 illustrates the arrangement for supporting plate 32 in its generally horizontal position. As shown therein support bar 30 is secured to rear wall 20 in any suitable manner. In a preferred form of this invention bar 30 would be slightly below the lower edge of is corresponding opening 28 so that the horizontal position of plate 32 is actually slightly below a precisely horizontal position thus creating a slight incline from the opening of the compartment to the rear wall which would aid in preventing objects from sliding out of the compartment.

Figure 4:
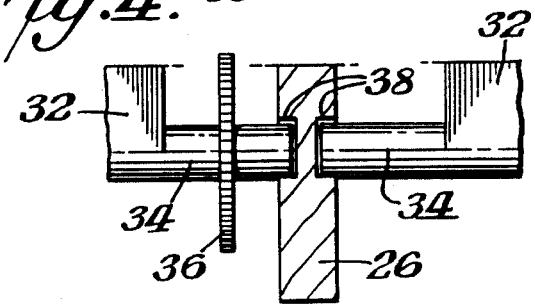
FIG. 4 is an elevational view partly in section showing the manipulating means for the message center of FIGS. 1–3.

FIG. 4 illustrates the manner of securing the plates for their rotational movement. As indicated therein inner wall 26 would have suitably shaped recesses 38 into which the ends of shafts 34 would be inserted. Plate 32 could be permanently mounted to shaft 34 or could be bent around the shaft and then be permanently fixed by any suitable fastener.

In the preferred practice of this invention a photograph is used to identify the individual corresponding to each compartment. The invention however may be practiced with any other forms of indicia or combinations of indicia. For example, instead of a photograph, a label bearing the individual's name may be placed on plate 32, or may be placed on the front wall 14 immediately below the corresponding opening. Labels may be placed alternatively on both the front wall and the plate. Instead of labels other indicia may be used such as color codes or geometric figures.

Figure 5:
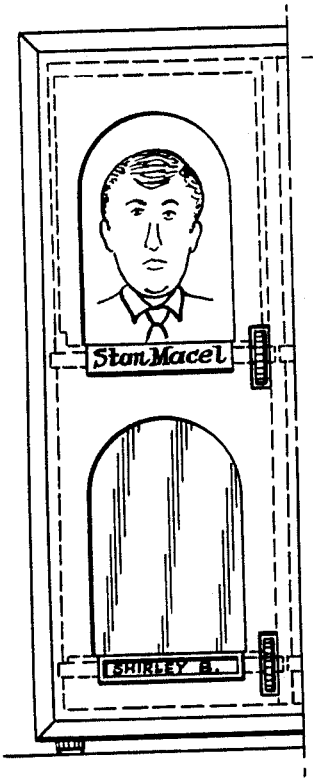
FIG. 5 is a front elevational view of a portion of a modified form of message center in accordance with this invention.
Figure 6:
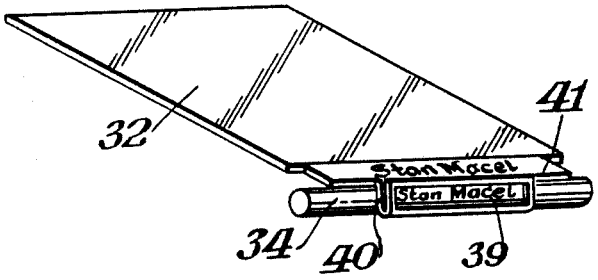
FIG. 6 is a perspective view of a plate used in the embodiment of FIG. 5.

FIGS. 5–6 illustrates a modified form of indicia for use with this invention. As shown therein the lower end at the base of plate 32 is bent in U-form to form a channel 40 offset from the base of plate 32. Front wall 14 would have openings into which channels 40 could be rotated. The front face of channel 40 may be in the form of a rim completely around its periphery with a central opening. A label or card or other insert 39 may be slipped into channel 40 and the name or other means of identification would be readily visable through the opening. Preferably the name on a card or label 41 would also be attached to plate 32 itself so that regardless of the position of plate 32 the name would be visible. In this respect as shown in FIG. 5 when plate 32 is in its generally horizontal position the insert 39 in channel 40 would be visable to indicate the individual. When however, plate 32 is rotated to its vertical position the channel 40 would likewise rotate through an opening in wall 14 and would no longer be visible, but the name on label 41 would appear on the main portion of plate 32.

It is also possible to practice the invention by providing some form of indicia such as a photograph or label on the back wall 20 which would be visible when plate 32 is in its generally horizontal position. FIG. 1 illustrates back wall 20 to have visible labels in two lower compartments. If desired, the top 22 of housing 12 could be transparent and a light could be provided shining through the housing so as to illuminate the compartments. Conversely, individual lights could also be provided for each compartment.

A further feature of this invention i the provision of locking means to assure that plate 32 will remain in its vertical position and not tend to fall back to the generally horizontal position. In the preferred practice of this invention, the locking means comprises magnets to hold plate 32 in contact with the front wall 14. For example, a magnetic strip 42 may be provided above each openings 28 and plate 32 could be made of a metal material or could have a corresponding magnetic strip located for contacting strip 42 when plate 32 is moved to the vertical position.

Invention may be practiced with many variations. For example, opening 28 may have any suitable shape such as a logo for advertising a particular company if for example a real estate company uses the message center the openings may be shaped as houses or as different types of houses or buildings in accordance with the particular realtors.

Figure 7:
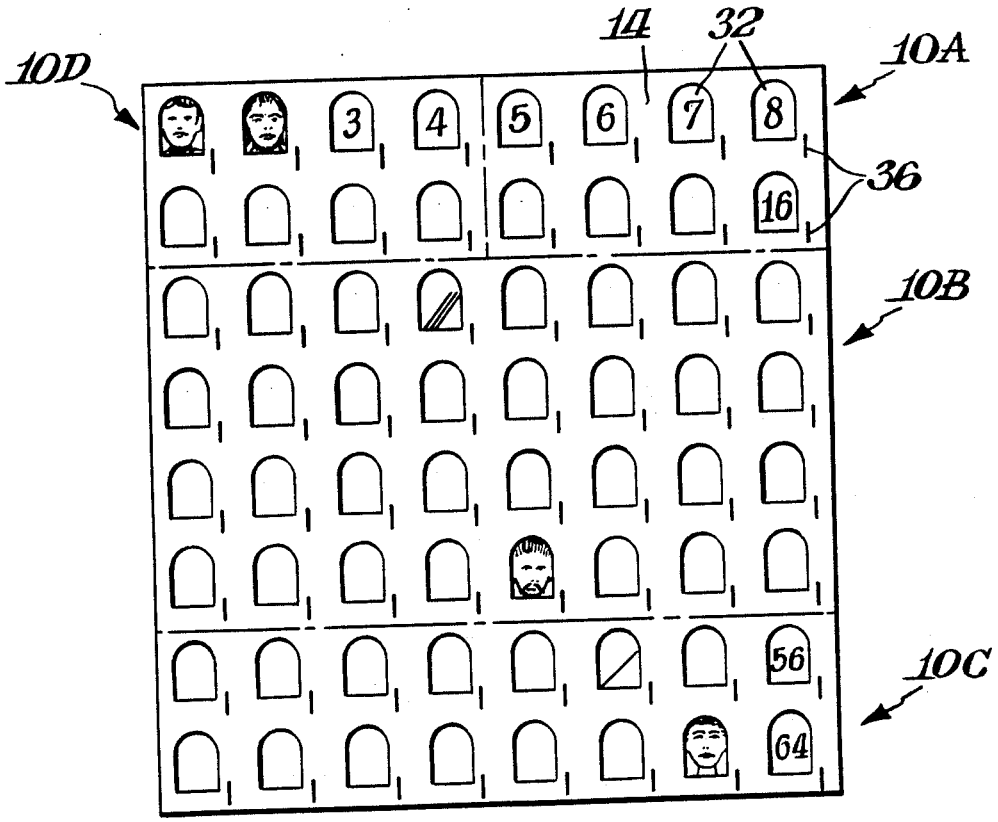
FIG. 7 is a front elevational view of a modified form of message center in accordance with this invention.

FIGS. 1–2 illustrate message center 10 to be of a desk type having two levels of compartments. In this embodiment housing 12 would be provided with feet 44 made of a non-scratch material such as rubber for setting on a desk. It is to be understood, however, that message center 10 could be made of other sizes and shapes. For example, FIG. 7 illustrates a plurality of message centers 10A, 10B, 10C and 10D. As shown, centers 10A and 10D are of the two layer eight unit size, while center 10B is of a larger four layer thirty-two unit size. Center 10C is of sixteen unit size. The centers may be secured together in any suitable manner, thus affording the opportunity of increasing or decreasing the number of compartments in accordance with the size of the company using message center 10.

It is also to be understood that message center 10 need not be a desk unit, but could be mounted to a wall either against the wall or within an appropriate recess in the wall.

Message center 10 may be made of any suitable materials. For example, front wall 14 could be of a painted aluminium, plastic or wood material which could be the same material or a different material from the remaining sides of housing 12.

Message center 10 may be used for various purposes and not simply to indicate the presence or absence of an individual. Each compartment may be used to correspond to any type person or item such as in a vehicle rental business to indicate that a particular vehicle is in and ready to be rented or is being used and thus is not available and the compartment may contain items personal to that vehicle such as rental information. Message center 10 may includes seasonal decorations or advertising logos, thus adding to its versatility. With a real estate firm openings 28 may be in the shape of houses or buildings.

Although any suitable form of indicia may be used, in the preferred practice of this invention a photograph is used as the indicia since it would be faster and simpler for a switchboard operator to use facial recognition rather than being required to read writing to know the identification of the particular individuals. Message center 10 offer the versatility of easily removing, adding or replacing the indicia since the photograph or other indicia may be attached in any suitable readily detachable manner. Thus, for example, a visitor or temporary employee may have a compartment assigned just as readily as a permanent employee.

It should thus be appreciated that message center 10 provides a convenient manner of readily identifying which individuals or other items such as vehicles are present and which are absent while at the same time being able to gather information such as messages pertinent to those individuals. In the broad practice of this invention it could also be possible to utilize a plurality of message centers at different locations in an organization with a central location electrically connected so that the central location would know whether or not individuals are present or absent at the more remote locations. For example, various segments of a building or a company may include message centers for the individuals who are physically working at that area and by the provision of sensors which would be contacted when plate 32 is moved to its vertical or horizontal positions a signal could be sent to a central area indicating whether the person is present or absent. One sensor for example, could be located on front wall 14 which when actuated by plate 32 being moved to the vertical position would cause a corresponding red light to light at a central panel thus indicating the presence of the individual. Similarly, a sensor on support bar 30 would cause a green light to light indicating the absence of the employee. Other manners of practising the invention would also become readily apparent to those in the art.

What is claimed is:

1. A message center comprising a housing, a plurality of compartments in said housing having a vertical front wall, a plurality of openings in said front wall corresponding to the number of said compartments, each of said openings being located at its corresponding compartment to provide access thereto, a plate being in each of said compartments movably mounted selectively to and from a generally horizontal position and a generally vertical position, said plate comprising the floor of its compartment to support any articles placed in said compartment when said plate is in said generally horizontal position, and said plate being disposed generally against said front wall to close its respective opening and comprise a door for its compartment when said plate is in said generally vertical position.

2. The message center of claim 1 including indicia on said plate for identification of an individual, and said indicia being visible when said plate is in said vertical position.

3. The message center of claim 2 wherein said indicia on each of said plates identifies a different individual whereby said plates may indicate the presence of the individuals identified by the vertical plates and the horizontal plates may support messages for individuals who are not present.

4. The message center of claim 3 wherein said indicia comprises a photograph of the individual.

5. The message center of claim 4 wherein said indicia further comprises a label having the name of the individual.

6. The message center of claim 5 including a channel mounted to the base of said plate at said front wall, and said label being an insert in said channel.

7. The message center of claim 6 wherein said channel is offset from the remainder of said plate, a second indicia being on said plate, said label being visible when said plate is in its horizontal position, and said second indicia being visible when said plate is in its vertical position.

8. The message center of claim 6 wherein said channel includes a frame around a window, and said label being visible through said window.

9. The message center of claim 2 including locking means for holding said plate in said vertical position.

10. The message center of claim 9 wherein said locking means comprises magnetic means.

11. The message center of claim 10 wherein said magnetic means includes a magnet on one of said plate and said front wall.

12. The message center of claim 9 wherein said plate is pivotally mounted to said front wall.

13. The message center of claim 12 wherein said plate is mounted on a shaft within its compartment, and a control knob secured to said shaft and accessible externally of said front wall to manipulate said shaft and control the position of said plate.

14. The message center of claim 13 wherein said housing includes a vertical rear wall, a plurality of support bars mounted on said rear wall corresponding to the number of said compartments, each of said support bars being disposed opposite a respective one of said openings in said front wall, and each of said plates being mounted on its respective support bar when said plate is in said horizontal position.

15. The message center of claim 14 wherein said plate comprises the sole floor of its respective compartment.

16. The message center of claim 14 including indicia on said rear wall for each of said compartment visible through its respective opening when said plate is in said horizontal position.

17. The message center of claim 2 including a plurality of said housings mounted together for increasing the number of individuals to be identified.

18. The message center of claim 1 wherein said plate is pivotally mounted to said front wall.

19. The message center of claim 18 wherein said plate is mounted on a shaft within its compartment, and a control knob secured to said shaft and accessible externally of said front wall to manipulate said shaft and control the position of said plate.

20. The message center of claim 1 wherein said housing includes a vertical rear wall, a plurality of support bars mounted on said rear wall corresponding to the number of said compartments, each of said support bars being disposed opposite a respective one of said openings in said front wall, and each of said plates being mounted on its respective support bar when said plate is in said horizontal position.

21. The message center of claim 19 wherein said plate comprises the sole floor of its respective compartment.

22. The message center of claim 1 wherein said plate is inclined slighted below said opening when said plate is in its generally horizontal position.

23. The message center of claim 1 wherein said plate includes an offset base, first indicia being on said offset base which is visible when said plate is in its horizontal position, and second indicia on said plate which is visible when said plate is in its vertical position.

24. A message center comprising a housing, a plurality of compartments in said housing, said housing having a vertical front wall, a plurality of openings in said front wall corresponding to the number of said compartments, each of said openings being located at its corresponding compartment to provide access thereto, each of said compartments having a floor to support any articles placed therein, a plate being in each of said compartments movably mounted selectively to and from a first position and a second position, said plate being visible when in said first position and comprising a door to close its respective opening for its compartment, said plate being disposed away from its respective opening when said plate is in said second position to permit access to its compartment and to permit articles to be inserted therein, indicia on each of said plates to identify an individual pertaining to its compartment, said indicia being visible when said plate is in said first position, and said indicia on each plate differing from said indicia on all other plates whereby the individual pertaining to each compartment may be readily identified so that articles pertaining to that individual may be inserted into the proper compartment.

25. The message center of claim 24 wherein said plate comprises said floor when said plate is in said second position.

* * * * *